US006158696A

United States Patent [19]

Brodskiy

[11] Patent Number: 6,158,696

[45] Date of Patent: Dec. 12, 2000

[54] RAILROAD ACCIDENT PREVENTION SYSTEM WITH GROUND-RETRACTABLE VEHICLE BARRIER

[76] Inventor: Arkadiy Brodskiy, 1255 -10$^{th}$ Ave. #6, San Francisco, Calif. 94122

[21] Appl. No.: 09/336,606

[22] Filed: Jun. 18, 1999

[51] Int. Cl.$^{7}$ ..... B61L 29/08

[52] U.S. Cl. ..... 246/125; 246/127; 246/292; 246/293; 246/294; 246/295; 49/49; 404/6

[58] Field of Search ..... 246/120, 121, 246/122, 125, 127, 293, 292, 304, 473.1; 404/6; 49/49, 131

[56] References Cited

U.S. PATENT DOCUMENTS

| | | | |
|---|---|---|---|
| 1,203,006 | 10/1916 | Keenan | 49/49 |
| 1,344,776 | 6/1920 | Strieter . | |
| 1,563,637 | 12/1925 | Lundblad | 49/49 |
| 1,603,285 | 10/1926 | Kennedy | 246/120 |
| 1,661,051 | 2/1928 | Siano . | |
| 1,818,824 | 8/1931 | Strauss . | |
| 1,857,868 | 5/1932 | Proper | 49/49 |
| 1,929,859 | 10/1933 | Strauss . | |
| 2,178,880 | 11/1939 | Miller | 39/6 |
| 2,189,974 | 2/1940 | Buford . | |
| 2,213,308 | 9/1940 | Evans | 246/122 |
| 2,219,127 | 10/1940 | Buford . | |
| 2,237,106 | 4/1941 | Minert . | |
| 2,251,699 | 8/1941 | Banschbach . | |
| 2,336,483 | 12/1943 | Hoover . | |
| 2,762,145 | 9/1956 | Rupe | 404/6 |
| 4,016,679 | 4/1977 | Ellefson | 49/49 |
| 4,318,079 | 3/1982 | Dickinson | 340/127 |
| 4,824,282 | 4/1989 | Waldecker . | |
| 5,288,164 | 2/1994 | Nasatka | 404/10 |
| 5,729,213 | 3/1998 | Ferrari et al. | 340/901 |
| 5,762,443 | 6/1998 | Gelfand et al. . | |
| 5,852,350 | 12/1998 | LeVoir | 318/466 |
| 5,864,304 | 1/1999 | Gerszberg et al. | 340/903 |

*Primary Examiner*—S. Joseph Morano
*Assistant Examiner*—Frautz Jules

[57] ABSTRACT

An apparatus that prevents motorists from crossing railroad tracks, when the warning gates are down during approaching of a train consists, of a plurality of tire-piercing cogs which are retracted from the ground when the railroad crossing gate is closed. The cogs are arranged across the entire width of the automobile road in order to prevent a motorist from going around the closed gate through the oncoming traffic lane. The piercing cogs are interlocked with a warning visual and/or sound signal which is activated if the vehicle went onto the railroad tracks and stuck on the rails after smashing the closed road gate arm. The cog drive mechanism is located below the ground level, and when the gate is open for normal traffic through the railroad crossing, the cogs are turned into position in which their back surfaces are arranged in flush with the ground level for smooth passage of the vehicles. The power station of the cog drive mechanism is located in a small pit between the lanes of the opposite-direction traffic.

16 Claims, 9 Drawing Sheets

RAILROAD ACCIDENT PREVENTION SYSTEM WITH GROUND-RETRACTABLE VEHICLE BARRIER

FIELD OF THE INVENTION

The present invention relates to a railroad accident prevention system with a ground-retractable vehicle barrier that prevents motorists from crossing railroad tracks when the warning gates are down during approaching of a train, and more particularly to a barrier which is retracted from the ground level when the railroad crossing gate is closed, in order to prevent a motorist from going around the closed gate.

BACKGROUND OF THE INVENTION

In the recent years accidents caused by collision of vehicles with the trains occur more often than in the past, probably because of intensification of traffic both on automobile roads and on railroads.

Attempts have been made heretofore to prevents accidents on railroad crossings. U.S. Pat. No. 5,762,443 issued to Gelfand; Matthew Jun. 9, 1998 describes a history of the problem referring to the US Patents mentioned below.

Thus, Strieter, U.S. Pat. No. 1,344,776, and Siano, U.S. Pat. No. 1,661,051, disclose railroad gates which are normally stored in a pit extending across the roadway parallel to a railroad track and which are raised into an obstructing position across the roadway. These gates are solid, being made of struts, bars, rods, or other solid pieces, and as such do not yield under impact. They act as immovable objects which can cause considerable damage to vehicles which collide with them and considerable harm to the occupants of those vehicles.

Strauss, in U.S. Pat. Nos. 1,818,824 and 1,929,859, provides a flexible, net-like barrier for a railroad crossing which drops from the top of a pair of posts into position to block the roadway. Cables connected to each end of the net are wound around a drum having a return spring. Collisions with the net unwinds the cables against the return spring bias which permits the net to yield, providing a cushioning effect which lessens the damage to the car and its occupants. The drums are raised and lowered on slides keyed to one wall of posts fixed to the ground. The strength of the system may have been adequate for automobiles of the 1930s, but the sliding drums could never sustain the impact forces caused by the speeds common in today's automobiles.

Buford, in U.S. Pat. Nos. 2,189,974 and 2,219,127, shows a railroad crossing gate made of wire mesh surrounded by a seemingly solid collar. Motor-driven cables raise and lower the gate on hollow posts embedded in a foundation in the ground. Impacts are resisted progressively by means of weights on an extensible cable system having a considerable number of moving parts, mainly the pulleys which guide and support the cables and weights. The wear and tear on these moving parts make maintenance a frequent and costly occurrence.

Minert, U.S. Pat. No. 2,237,106, discloses a highway barrier comprising a flexible net whose cables are wound onto a pair of drums. An oppositely wound pair of cables compress springs in a pair of underground tubes to retard the movement of the vehicle which hits the net. Banschback, U.S. Pat. No. 2,251,699, shows a railroad crossing gate made entirely of wire cables with no solid parts. The gate deflects under impact against the restraining force of a pair of spring tubes 16 running parallel to the roadway on both sides thereof Hoover, U.S. Pat. No. 2,336,483, shows a deflectable railroad crossing barrier consisting of a net made entirely of wire cables. The net is connected at each end to a telescoping spring tube embedded in the ground parallel to the roadway. Each of these systems requires costly construction in order to embed the shock-absorbing spring tubes in the ground.

Waldecker, U.S. Pat. No. 4,824,282, shows a roadway barrier to stop terrorist intrusions into restricted spaces. A flexible net and inflatable airbags are located in a pit transverse of the roadway. When inflated the airbags raise the net, positioning it across the entire road. The ends of the net are connected to heavy-duty shock absorbers buried in concrete in the ground on both sides of the roadway. The shock absorbers include springs and/or fluids to dissipate the force of the impact while permitting deflection of the net. The cost of excavation and construction necessary to build this system may be worthwhile when limited to military bases, diplomatic compounds, or the like, but it is prohibitive when applied to the number of railroad crossings which should be protected by a restraining barrier.

Aforementioned U.S. Pat. No. 5,762,443 describes a heavy duty shock absorber system for resisting large forces as may be encountered, for example, in a restraining barrier for a railroad crossing. The system consists of two pairs of deep concrete bunkers, each pair being located on opposite sides of the railroad tracks. Each pair consists of two concrete bunkers arranged on opposite sides of the automobile road that crosses the railroad. Each bunker supports an upstanding concrete-filled steel pipe with a hydraulic, compressive shock absorber mounted on the steel pipe. Two grooves are formed in the ground on opposite sides of the railroad tracks. The grooves are parallel to the railroad tracks and contain metal nets the ends of which are attached to the retractable posts. When the train approaches the railroad crossing, the posts move upward and raise the metal net above the ground similar to a volleyball net stretched on the path of the vehicles.

A disadvantage of such a system consists in that it requires installation of four deep bunkers with four heavy ground structures for the upper ends of the posts and for post drive mechanisms. These ground structures have significant dimensions comparable with the size of the vehicles. Another disadvantage is that the mechanisms for raising the nets should be extremely powerful. This is because in the grooves can be filled with water which can be frozen and turned into ice compacted under the pressure of vehicles passing over the grooves in both directions. For the same reason the metal nets may be jammed and stuck in an upraise position thus causing a serious traffic problem.

Very often, however, collisions between trains and vehicles are caused on conventional railroad highway crossings of the type shown in FIG. I in an attempts of motorists to go around the gate arms when they are in a road-closing position. FIG. 1 is a plan view of a railroad crossing where highway 10 goes across railways 12 and 14. Reference numerals 16 and 18 designate gate arms in their road-closing positions. Each gate arm closes corresponding lanes for vehicles going in one direction. It can be seen that a motorist of a vehicle 20 can bypass the gate arm 16 going around it via the lanes for traffic in the opposite direction, e.g., along the path shown by a broken line L.

Furthermore, a disadvantage of all known systems described above is that none of them is interlocked with a visual or sound warning signal that may be activated if the barrier has failed and a vehicle has stuck on the railroad tracks.

OBJECTS OF THE INVENTION

It is an object of the present invention is to provide a system for preventing accidents caused by collision of railroad trains with vehicles on highway-railroad crossings. It is another object is to provide a system of the aforementioned type which is simple in construction and maintenance, inexpensive to manufacture, reliable in operation, and prevents motorists from going around railroad gates in their working or road-closing positions. Still another object is to provide a vehicle barrier which is retractable from the ground when the highway gate is closed and which is interlocked with a warning signal which is activated when a vehicle is stuck on the railroad tracks with the barrier in an upright position.

SUMMARY OF THE INVENTION

An apparatus that prevents motorists from crossing railroad tracks, when the warning gates are down during approaching of a train consists, of a plurality of tire-piercing cogs which are retracted from the ground when the railroad crossing gate is closed. The cogs are arranged across the entire width of the automobile road in order to prevent a motorist from going around the closed gate through the oncoming traffic lane. The piercing cogs are interlocked with a warning visual and/or sound signal which is activated if the vehicle went onto the railroad tracks and stuck on the rails after smashing the closed road gate arm. The cog drive mechanism is located below the ground level, and when the gate is open for normal traffic through the railroad crossing, the cogs are turned into position in which their back surfaces are arranged in flush with the ground level for smooth passage of the vehicles. The power station of the cog drive mechanism is located in a small pit between the lanes of the opposite-direction traffic.

DETAILED DESCRIPTION OF THE INVENTION

Figure 1:
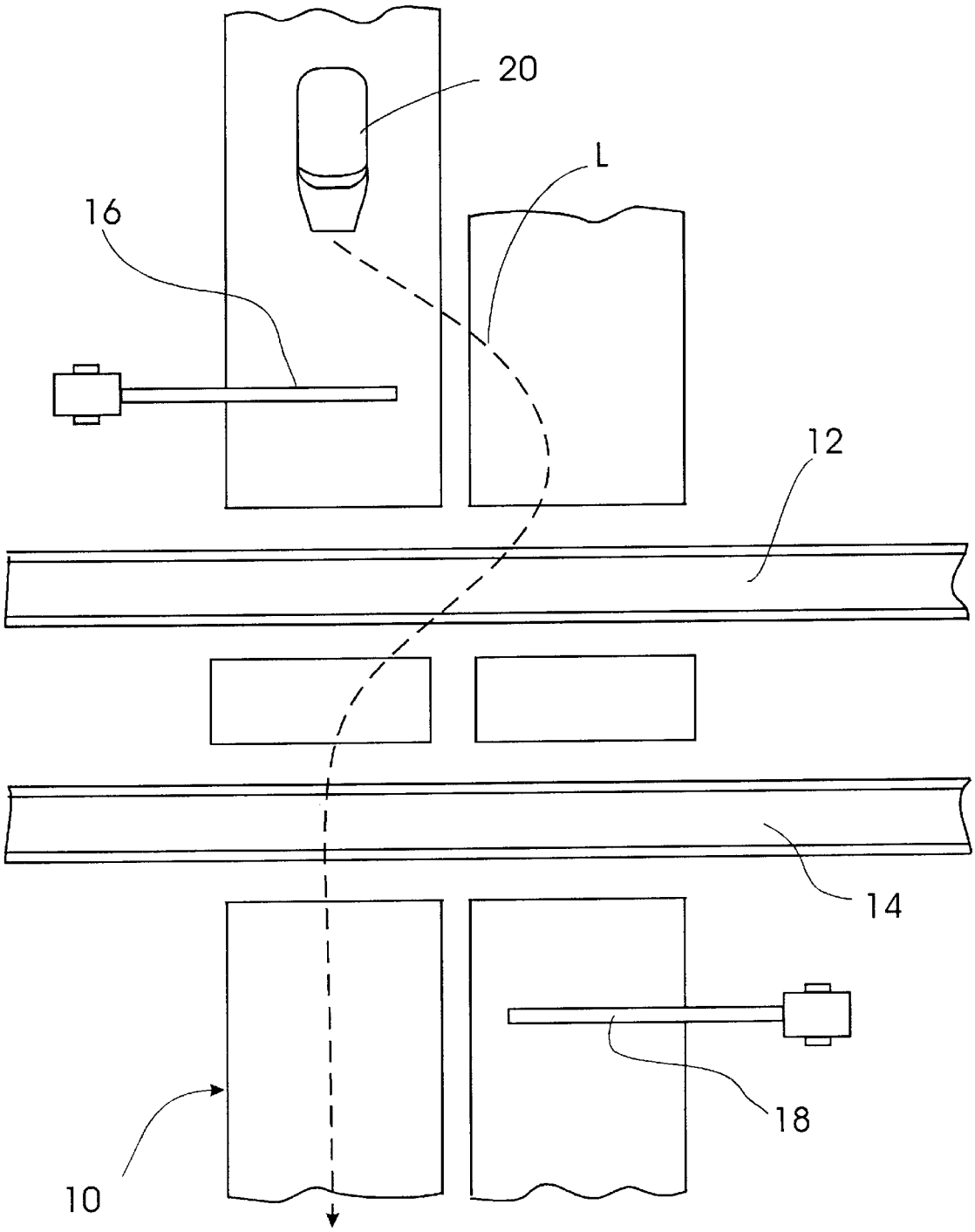
FIG. 1. PRIOR ART
FIG. 1 is a plan view of a conventional highway-railroad crossing with railroad crossing gate arms in their road-closing positions.
Figure 2:
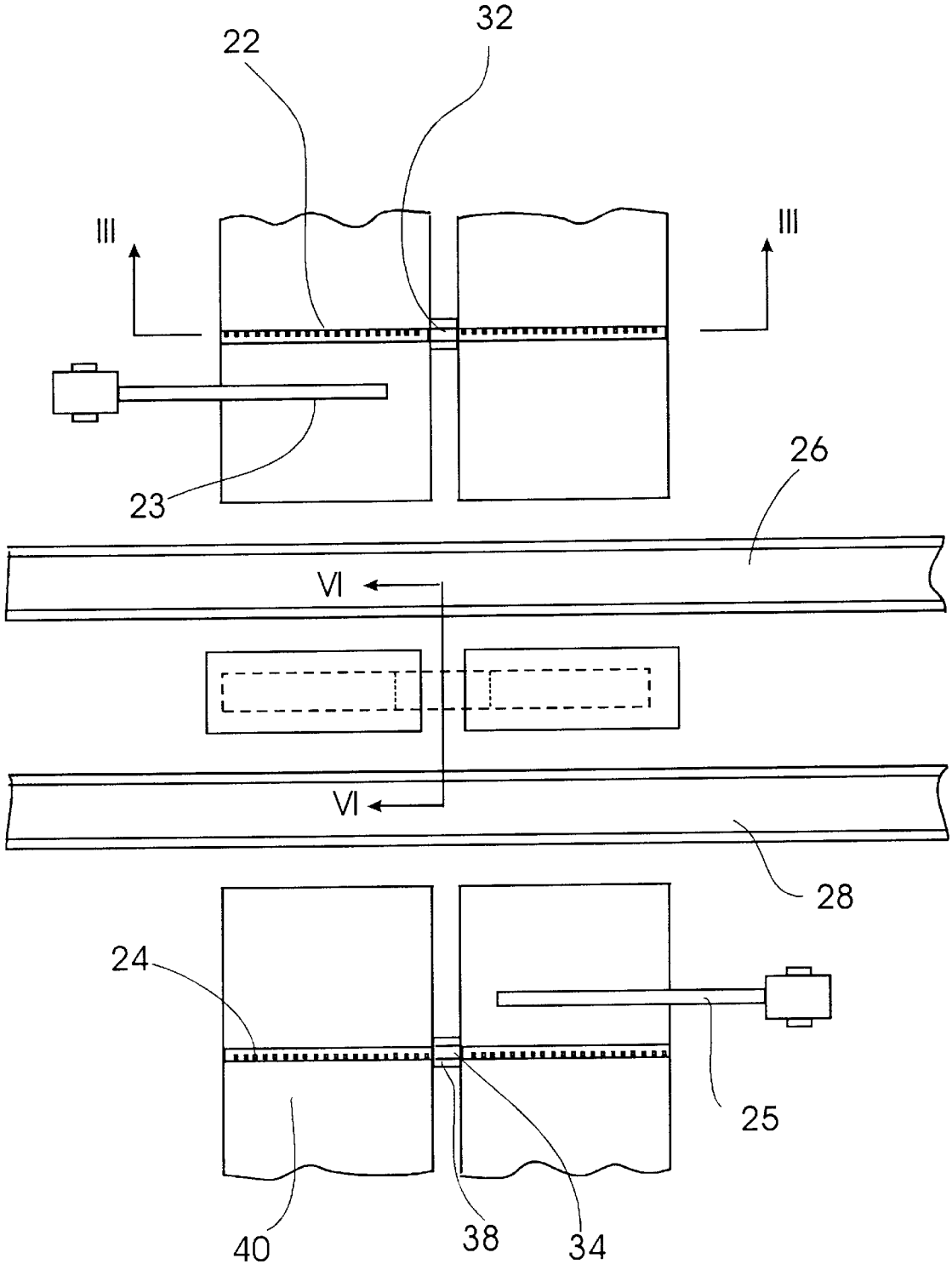
FIG. 2 is a plan view of a highway-railroad crossing equipped with the accident prevention system of the present invention.
Figure 3:
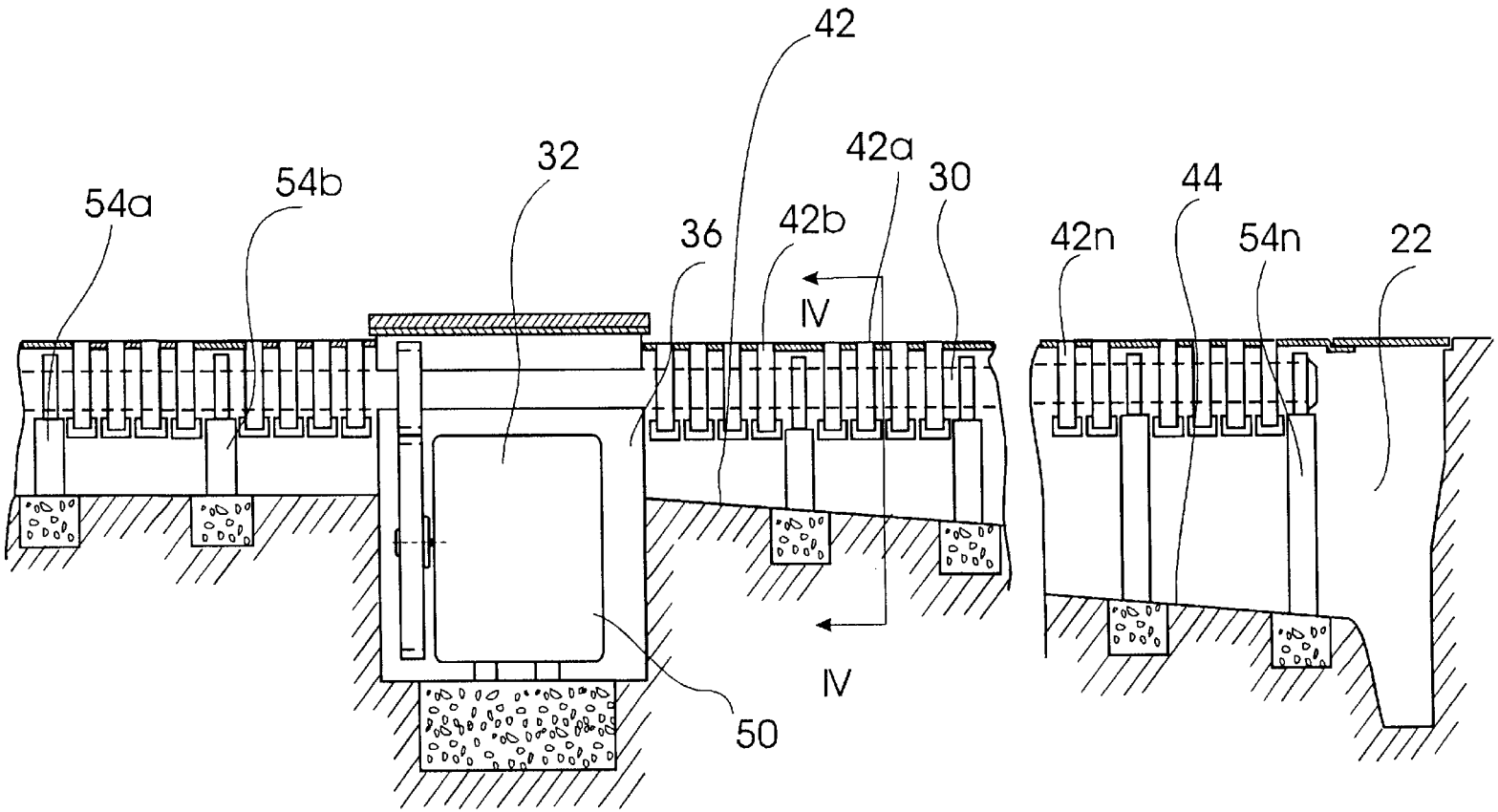
FIG. 3 is a sectional view of the system of the invention along the line III—III of FIG. 2.

FIG. 2 is a plan view of a highway-railroad crossing equipped with the accident prevention system of the present invention, and FIG. 3 is a sectional view along the line III—III of FIG. 2. The system of the invention consists of recesses or trenches 22 and 24, dug through the ground on both sides of the railroad tracks in the directions parallel to each other and to the railroad tracks 26 and 28, shafts 30 rotationally supported in the trenches 22 and 24, respectively (only one shaft 30 of these two shafts is shown in the drawings), and shaft drive mechanisms 32 and 34 located in pits 36 and 38 formed in the middle between the lanes of the traffic going in the mutually opposite directions. The railroad tracks 26 and 28 are intersected by a highway 40 that passes through the railroad crossing.

As shown in FIG. 3, trench 22 (and similarly, trench 24) has slopes 42 and 44 inclined downwardly and outwardly from the pit 36 (and similarly, from the pit 38). It is necessary for preventing water pouring into the pits or from accumulating in the trenches. The water is then drained from the trenches through sewage water pipes (not shown).

Figure 4:
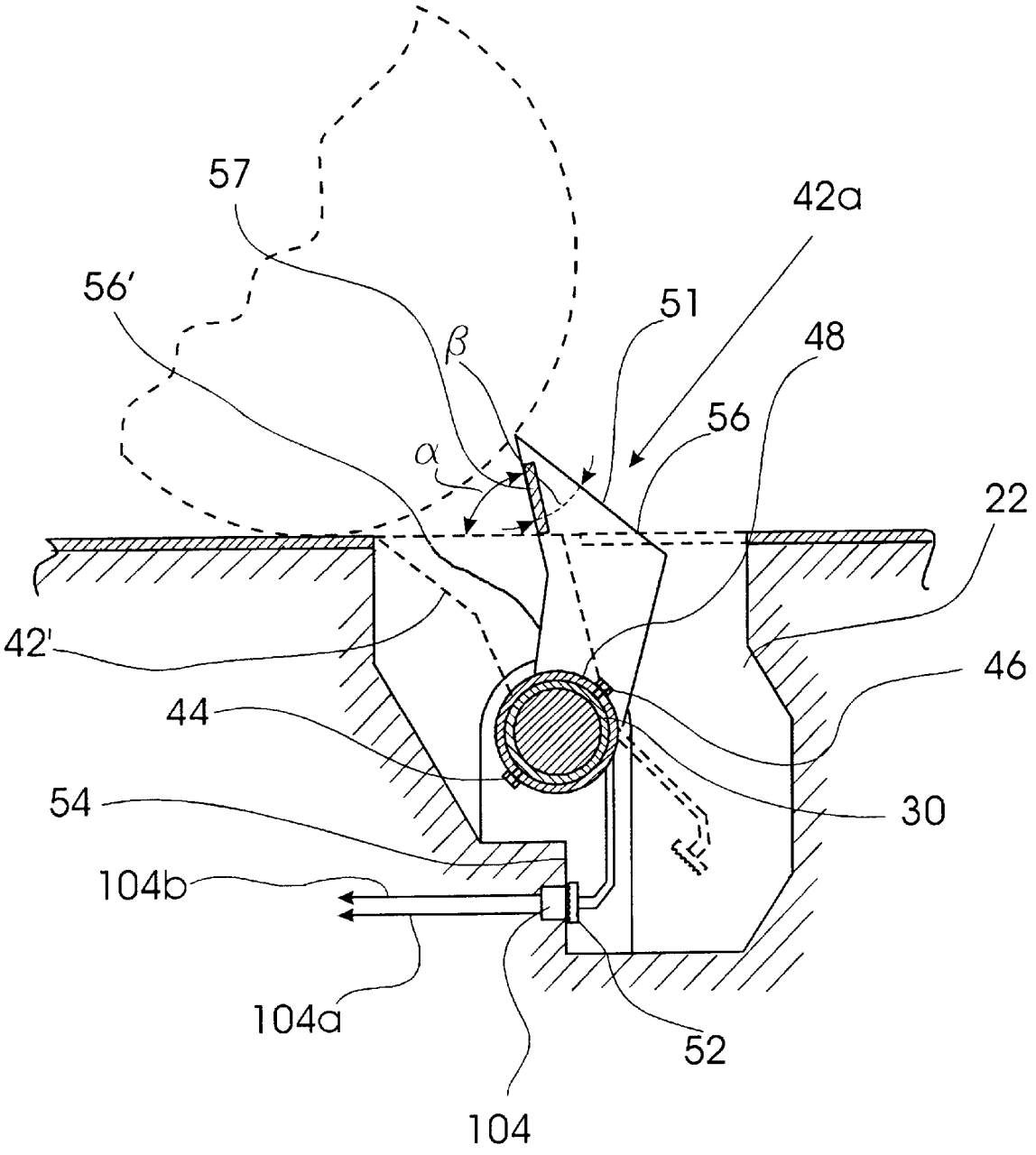
FIG. 4 is a sectional view along the line IV—IV of FIG. 3 illustrating the construction of a tire-piercing cogs.

FIG. 4 is a sectional view along the line IV—IV of FIG. 3 illustrating the construction of a tire-piercing cogs. It can be seen that shafts 30 support a plurality of tire-piercing cogs 42*a*, 42*b*, . . . 42*n* (FIG. 3) which are rigidly attached to shafts 30, e.g., by bolts 44, 46 screwed into the shaft 30 through a hub portion 48 of each cog. It is understood that the bolt connection is shown only as an example and that other connection means, such as splines, can be used for attaching the cog.

All the cogs have identical construction and relative position with respect to the shaft, and therefore only one of them, i.e., cog 42*a* will be considered in detail with reference to FIG. 4. For the same reason, in the description of the cog, singular should be understood as plural. As can be seen from this drawing, the cog 42*a* is made in the form of a two-am lever having one arm shaped as a sharp tooth-like tip 51 and another arm as a flat heel 52. The cog 42*a* is made of a strong steel with high resistance to impacts and bending forces. The cog 42*a* may be turned between two positions. In the working position, which is shown in FIG. 4 by solid lines, the sharp tip 51 projects upward at an acute angle $\alpha$ in the direction of the oncoming vehicles, and the heel 52 comes into contact with a stopper 54 on the bottom of the trench 22. This angle can be between 15° and 75°. The tip angle $\beta$ can be within the range of 10° to 75°. It is understood that these ranges are given as an example. In a non-operative position, shown in FIG. 4 by a broken lines 42', the sharp tip 51 is turned down so that the relief surface 56 of the cog 42*a* becomes coplanar with the surface of the highway 40 and does not create obstacles to the vehicles that pass through the railroad crossing. In this position, the heel 52 is moved away from the stopper 54. The front surface 56' of the cog may support a light-reflecting element 57 for making the raised cogs visible at night time.

The working position of the cogs, shown by solid lines in FIG. 4, corresponds to the closed position of gate arms 23 and 25 (FIG. 2), whereas the inoperative position of the cogs corresponds to the open position of the arms 23 and 25, i.e., when the vehicle are allowed to pass through the railroad crossing.

Figure 5:
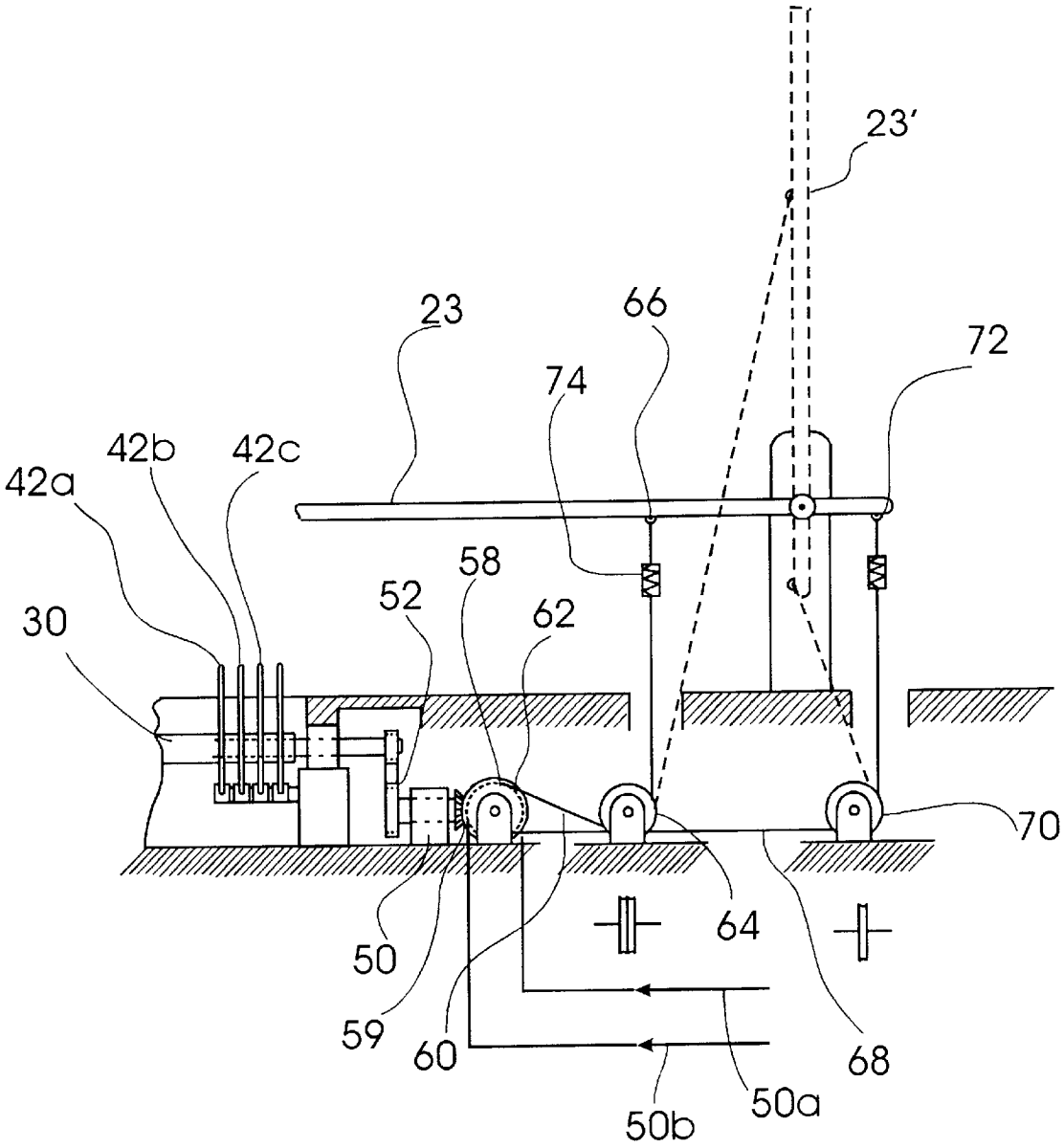
FIG. 5 is a side view similar to FIG. 3 illustrating mechanism for synchronization of rotation of the cogs with opening and closing of the gate arms.

The cogs 42*a*, 42*b*, . . . 42*n*, as well as the identical cogs on the opposite side of the railroad are turned from the working position to inoperative position by means of the shaft 30 and its respective drive mechanism 34 (only the shaft 30 and drive mechanism 34 will be considered below, as both shafts and their drives are identical). The drive mechanism is shown in FIGS. 3 and 5, where FIG. 3 is a sectional view of the system of the invention along the line III—III of FIG. 2 (where the gate bar drive mechanism is not shown), and FIG. 5 is a side view similar to FIG. 3 illustrating mechanism for synchronization of rotation of the cogs with opening and closing of the gate arms 23 and 25.

As shown in the above drawings, the drive mechanism consists of a drive motor 50 which transmits rotation to the shaft 30 via a gear train 52. The drive motor is connected by lead wires 50*a* and 50*b* (FIG. 5) to the existing general railroad traffic controller (not shown) that sends closing and opening commands to gate arms in existing railroad crossing gates. Reference numerals 54*a,* 54*b,* . . . 54*n* designate bearing supports for the shaft 30. The motor 50 also transmits rotation to the gate arm 23 via a transmission mechanism consisting of a gear reducer, which for simplification purposes is shown as a pair of bevel gears 59 and 58, and a pair of steel ropes. For this purpose, the sheaves 62 and 64 are double-groove sheaves. One steel rope 60 is guided over one groove of the sheaves 62 and 64 and is connected to the gate arm 23 at a point 66, and another rope 68 is guided through the second groove of the sheaves 62 and 64 and a sheave 70 and is connected to the end of the gate arm 23 at a point 72. Each steel rope has a flexible stretchable link 74 and 76, respectively, to compensate for change in the length of the rope with raising or lowering of the gate arm 23.

An essential feature of the present invention is that the aforementioned vehicle-barrier type accident prevention system is interlocked with an alarm system which generates a powerful visual and/or sound signal if, for some reason, the tire piercing cogs could not prevent the vehicle from entering the railroad tracks and the vehicle is stuck on the tracks.

Figure 6:
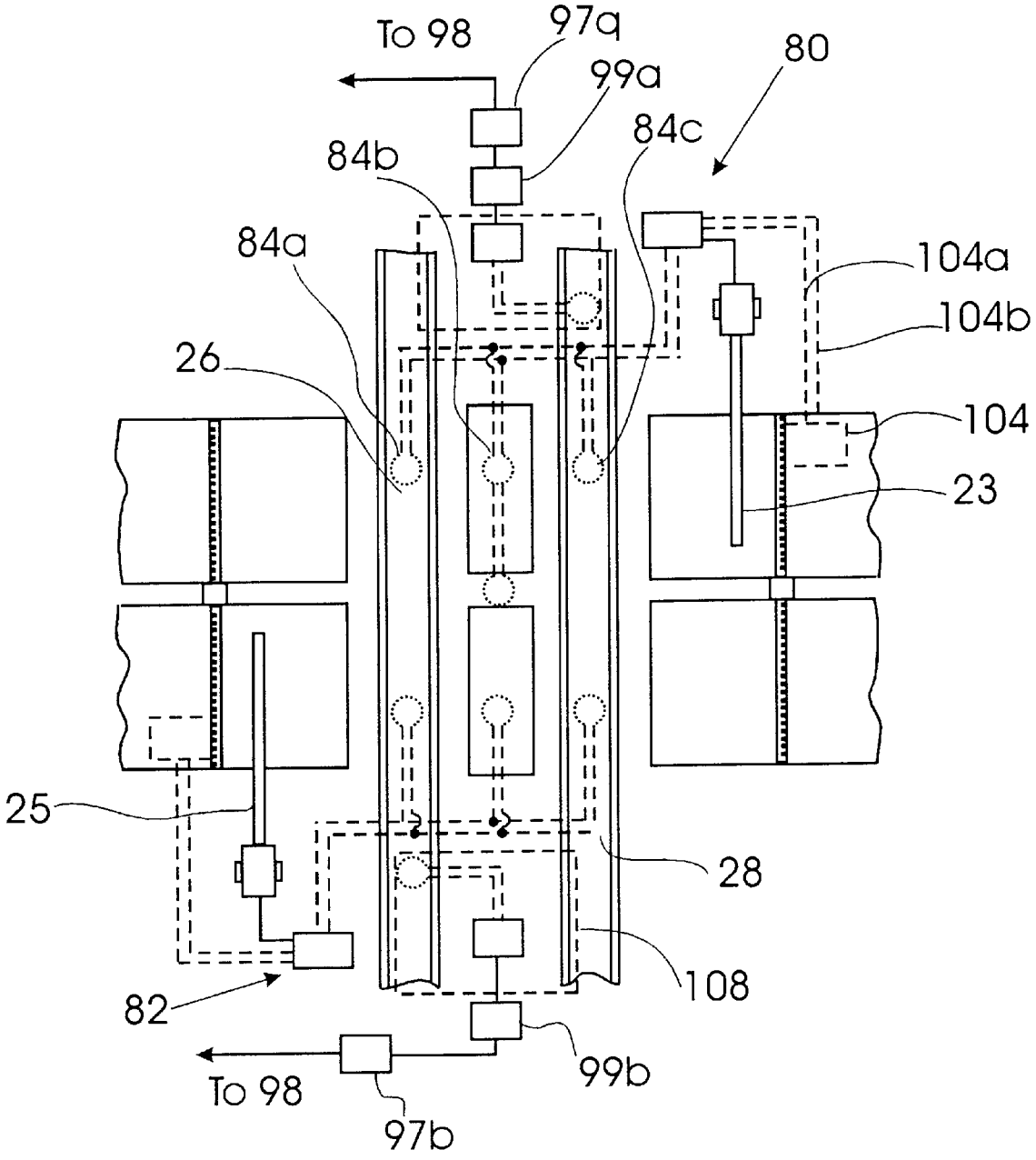
FIG. 6 is view similar to FIG. 2 illustrating an alarm system connected with the vehicle-barrier type system of the present invention.
Figure 7:
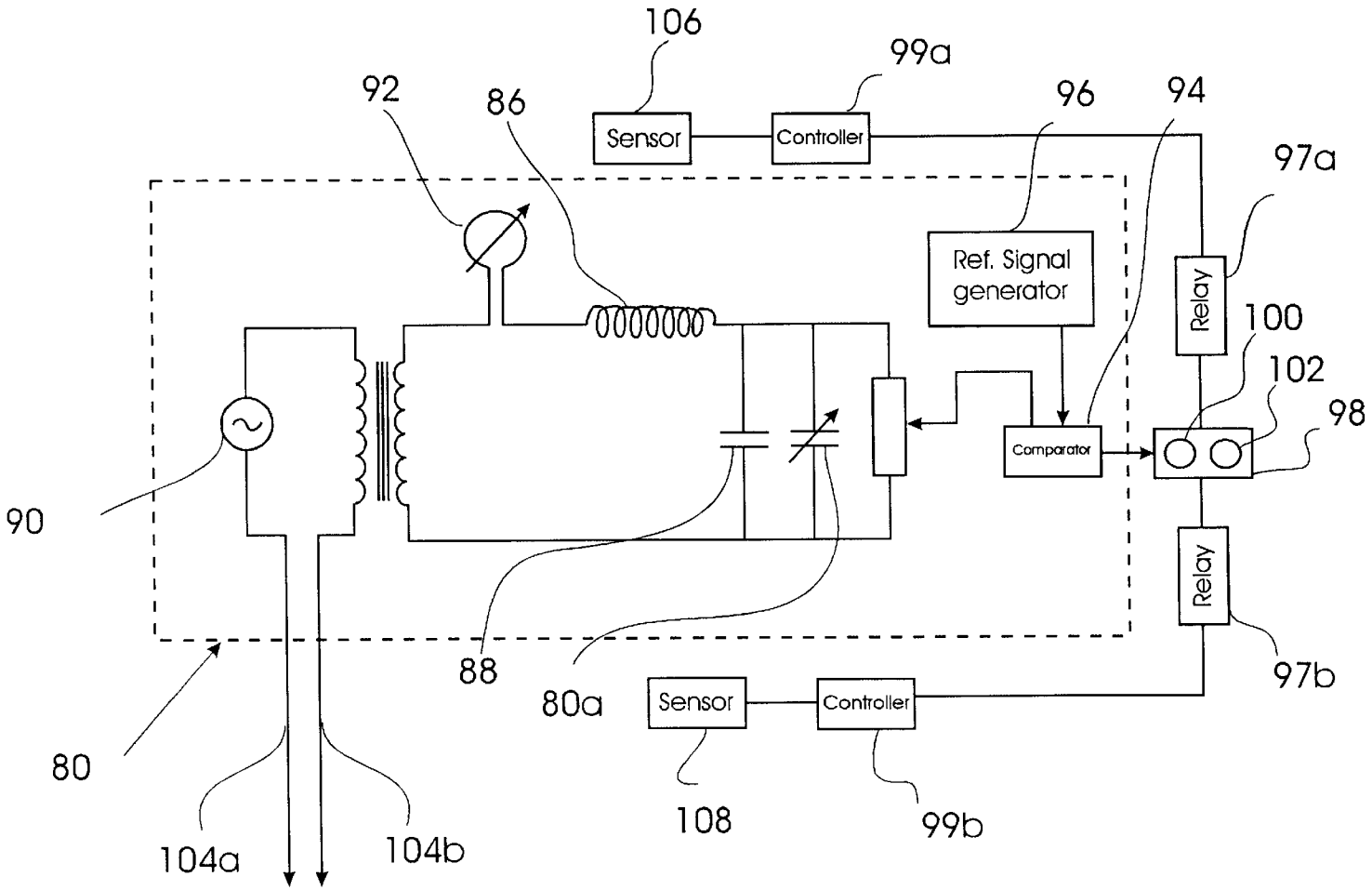
FIG. 7 is an electric circuit which connects the alarm system with the vehicle-barrier type accident prevention system of the present invention.

FIG. 6 is view similar to FIG. 2 illustrating an alarm system connected with the vehicle-barrier type system of the present invention. FIG. 7 is an electric circuit which connects the alarm system with the vehicle-barrier type accident prevention system of the present invention.

As shown in FIG. 6, an alarm system consists of a pair of sensor devices 80 and 82 operation of which is interlocked with closing and opening of gate arms 23 and 25, respectively. Since both sensor devices are identical, only one of them e.g., sensor device 80 will be described with reference to FIGS. 4, 6, and 7.

The sensor device 80 consists of three inductance elements 84*a,* 84*b,* and 84*c,* e.g., in the form of wire loops which would react on variation in magnetic permeability caused, e.g., by the presence of a vehicle having parts made of ferromagnetic materials, e.g., an engine or car body. The inductance element 84*a* is located between the rails of the railroad tracks 26, the inductance element 84*c* is located between the rails of the railroad tracks 28, and the inductance element 84*b* is located between both tracks 26 and 28. The inductance elements can be placed into the ground or onto the ground surface. In FIG. 7, which is an electric circuit of the sensor devices and the alarm system, the inductance elements are shown as a coil 86 in an oscillating circuit that also includes a capacitance 88 and an AC source 90. In FIG. 7, the aforementioned inductance elements 84*a,* 84*b,* and 84*c* are shown as a single variable inductance element 92 which functions as a sensor and is connected into the oscillating circuit. Normally, without the presence of a big mass of metal, such as a vehicle, that may violate normal operation of the circuit, the oscillating circuit operates in resonance. An output of the oscillating circuit is connected to a comparator 94 which also receives a constant voltage signal from a reference signal generator 96. The constant voltage AC signal of generator 96 has a predetermined threshold value which is compared with the output signal of the oscillating circuit, i.e., of the sensor device 80. The output of the comparator 94, in turn, is, connected to an alarm apparatus 98 that may contain a visual alarm signal generator 100 and/or sonic alarm signal generator 102. A visual alarm signal generator 100 may be a powerful red-light projector directed towards the oncoming train, the sonic alarm signal generator may be a powerful siren. The alarm apparatus 98 is interlocked with operation of cogs 42*a,* 42*b,* . . . 42*n,* and hence of gate arms 23 and 25 via a limit switch 104 (FIG. 4). This limit switch is connected to the sensor device 80 by lead wires 104*a* and 104*b* (FIG. 7).

A second interlock is provided between the pair of the aforementioned sensor devices 80 and 82 and a second pair of sensor devices 106 and 108, respectively. The sensor devices 106 and 108 have the same structure and electrical circuits as sensor devices 80 and 82 shown in FIGS. 6 and 7. However, they are located in positions ahead of sensors 80 and 82 in the direction of movement of trains. In other words, a train reaches positions of sensor devices 80 and 82 prior to reaching the railroad crossing. The purpose of the second interlock is to prevents activation of the sensors 80 and 82, and hence, the alarm device 98, under the effect of the train itself, when the latter approaches or passes through the intersection with the gate arms 23 and 25 in a closed position, the cogs 42*a,* 42*b* . . . 42*n* in a raised position, and with the activated limit switch 104.

Thus, the limit switch 104 functions as a first interlock device which interlocks the operation of the cogs 42*a,* 42*b,* . . . 42*n* with the operation of the sensor device 80 (and 82 on the other side of the railroad crossing) and of the alarm device 98, whereas the sensors device 106 and 108 function as second interlock device the operation of which is interlocked with the operation of the alarm device 98.

In both case, interlock is carried out through conventional electromechanical or solid state relays which are schematically shown in FIG. 6 and FIG. 7 by reference numerals 97*a* and 97*b*. As shown in FIG. 7, sensor device 106 is connected to the alarm device 98 via a controller 99*a* and the aforementioned relay 97*a*. The similar connection is carried out between the sensor device 108 and the alarm device 98 via a controller 99*b* and the aforementioned relay 97*b*. Thus, in the case when there is no obstacle on the railroad tracks in both directions of the train, the alarm will be de-energized. Neither it will respond to the train itself without being first activated by sensors 84*a,* 84*b* . . . .

Figure 8:
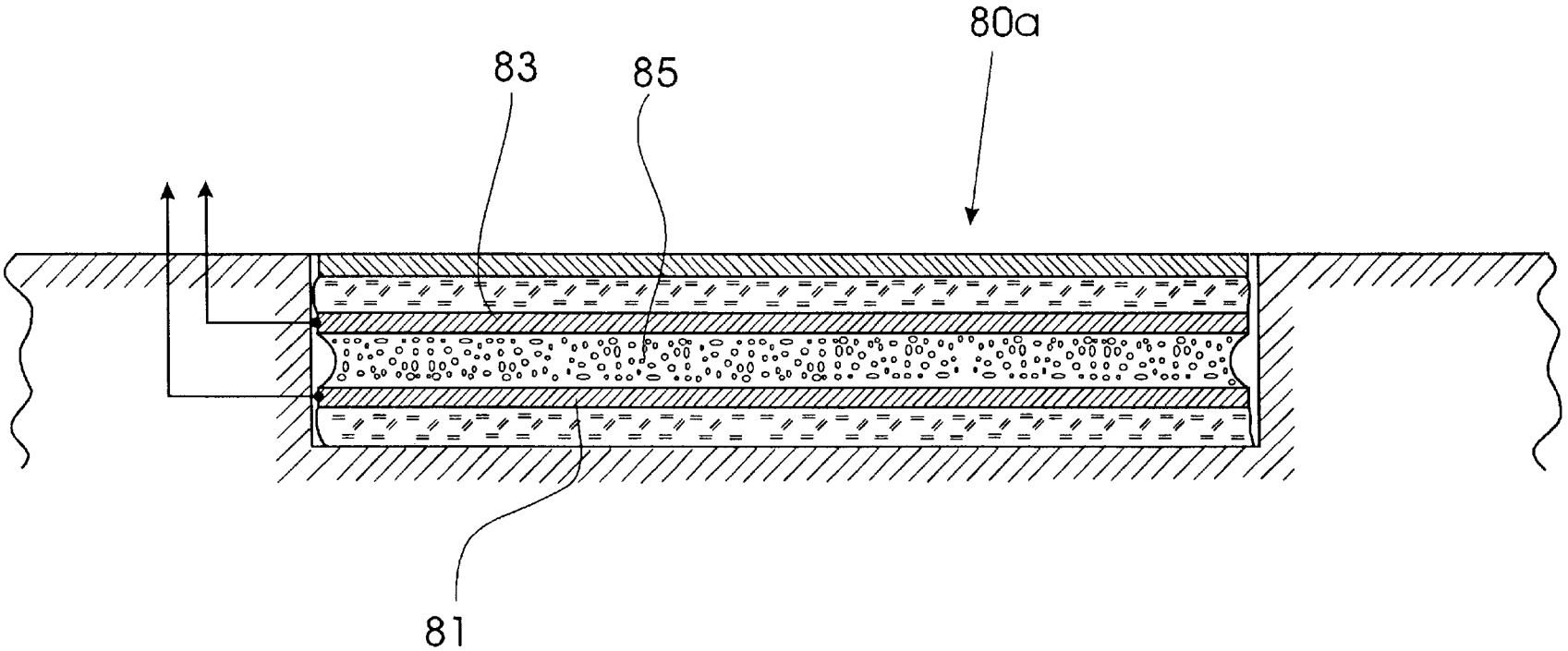
FIG. 8 is a schematic sectional view of a dilatometer-type weight sensitive element for detecting the presence of an obstacle on the railroad tracks, the section being made along line VIII—VIII in FIG. 2.

The sensor device 80 of the type shown and described above will be sensitive not only to objects having massive metal parts, i.e., vehicles, motorcycles, etc., but also to non-metal objects, such as, e.g., a crowd of people, a heard of domestic animals, or just a single cow on the railroad tracks. As shown in FIG. 7, this is achieved by incorporating into sensor 80 a dilatometer 80*a* shown in FIG. 8 which is a schematic sectional view of a dilatometer-type weight sensitive element for detecting the presence of an obstacle on the railroad tracks, the section being made along line VIII—VIII in FIG. 2.

In a simplified form, dilatometer 80*a* is made in the form of a pair of metal plates 81 and 83 and a rubber sheet 85 sandwiched between the plates 81 and 83. When a heavy load, such as a cow, exerts a pressure onto the plates 81 and 83 and changes a distance between them, this will change resonance frequency of the oscillating circuit of the sensor shown in FIG. 7 and thus will change the output signal sent from the sensor to the comparator 94. As shown FIG. 7, the dilatometer 80*a* is connected to the oscillating circuit in parallel with the capacitance 88.

Operation of the Accident Prevention System of the Invention

When in the absence of the approaching train the gate arms 23 and 25 are in an open or raised position shown for the gate arm 23 in FIG. 5 by broken lines 23', the shaft 30 is turned by the motor 50 into a position in which cogs 42*a,* 42*b,* . . . 42*n* are in a lower position shown in FIG. 4 by broken lines 42' in which the sharp tips 51 are turned down so that the relief surfaces 56 of the cogs 42*a,* 42*b* . . . 42*n* become coplanar with the surface of the highway 40 and do not create obstacles to the vehicles that pass through the railroad crossing. In this position, the heel 52 is moved away from the stopper 54 and hence from the limit switch 104. The circuit of the sensor 80 is open, and the circuit of the alarm apparatus 98 is de-energized. With this position of the cogs 42*a,* 42*b,* . . . the vehicles can freely pass through the railroad crossing, and the alarm will not be activated, as both sensor device 80 and 82 are de-energized. When train approaches the highway-railroad crossing equipped with the accident prevention system of the present invention shown in FIGS. 2 through 7, the drive motor 50 is activated by a command sent to the motor 50 via lead wires 50*a* and 50*b* (FIG. 5) from the existing general railroad traffic controller (not shown) that sends closing and opening commands to gate arms in existing railroad crossing gates. The motor 50 is activated and transmits rotation to the shaft 30 via a gear train 52. The motor 50 also transmits rotation to the gate arm 23 via a reducer . . . shown as bevel gears 59 and 58 and a pair of steel ropes 60 and 68.

As the motor 50 rotates, the shaft 30 of the motor turns the cogs 42*a,* 42*b,* . . . 42*n* from the lower position shown in FIG. 4 by broken lines 42' to the solid-line position of FIG. 4 in which the cogs are raised up by angle $\alpha$ so that in case of collision with a vehicle they will stop the vehicle or even may pierce the vehicle's tires for preventing its penetration to the railroad tracks 26 and 28 in case of the approaching train.

When the cogs 42*a,* 42*b,* . . . 42*n* reach their uppermost position, the heel 52 on each of the respective cogs comes into contact with a stopper 54 on the bottom of the trench 22 and at the same time the heel on one of the cogs engages the limit switch 104. The latter is connected via wires 104*a* and 104*b* with sensor device 80. Similar arrangement and connections (not shown) are made on the other side of the railroad crossing.

Under this condition, the sensors and alarm system are in an operative condition ready for activation in case of necessity. Such a necessity occurs when a vehicle or another obstacle having a mass sufficient for violating the resonance conditions of the sensor device 80 appears and stuck on the rails. If the resonance condition of the sensor devices 80 and 82 is violated and the signal on the output of the comparator 94 drops to the value or below the value of the constant voltage signal of generator 96, the comparator 94 will generate on its output a signal that will activate the visual alarm signal generator 100 and/or sonic alarm signal generator 102. In the case of the dilatometric sensor 80*a* of the type shown in FIG. 8, the difference will be only in that the variation in the frequency of the oscillating circuit will be cause by variation in the distance between capacitance plates 81 and 83 under the effect of a load applied to the plates from an object on the tracks, e.g., a vehicle or a large animal.

If a train approaches the railroad crossing, and there is no obstacle on the tracks, the sensor device 106 will detect the train. This will violate resonance conditions of sensor device 106, whereby an output signal of the sensor device 106 will be sent to the controller 99*a* and then from the controller 99*a* to the relay 97*a*. The latter will de-energize the alarm 98.

Similar action will occur in the sensor device 108 when the train approaches the railroad crossing from the opposite side.

The return of the cogs 42*a,* 42*b,* . . . 42*n* to their initial position shown by broken line 42' in FIG. 4 is initiated by reversing the motor 50 (FIG. 3) under the command generated by lifting the gate arm 23 (FIG. 5).

Figure 9:
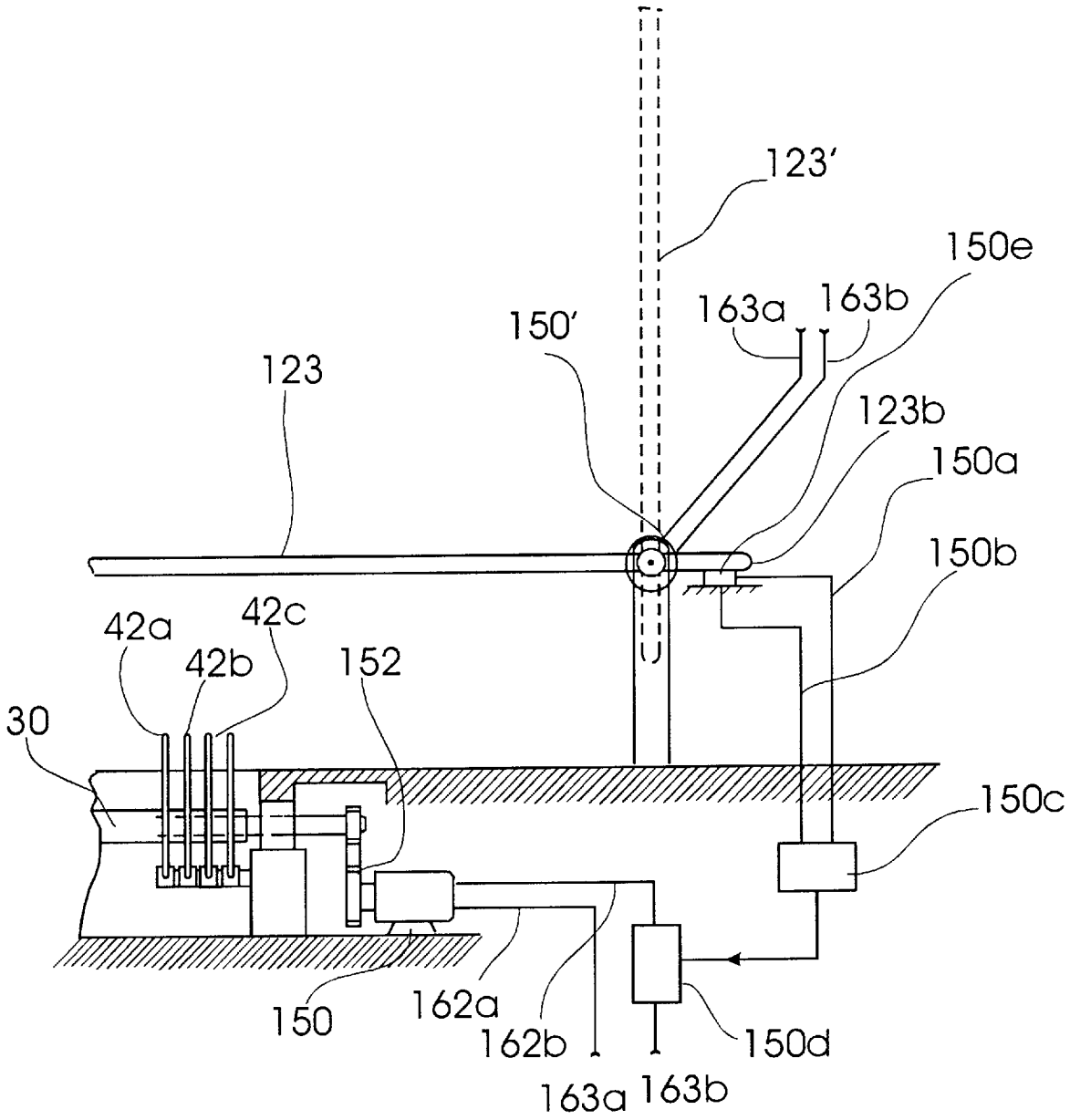
FIG. 9 is a schematic side view similar to FIG. 5 illustrating another embodiment of the invention in which connection between the drive of the cogs and the drive of the gate arm is performed electrically without kinematic links.

FIG. 9—Embodiment of the System of the Invention with Separate Drive motors for the Barrier and the Gate Arm FIG. 9 is a schematic side view similar to FIG. 5 illustrating another embodiment of the invention in which connection between the drive of the cogs and the drive of the gate arm is performed electrically without kinematic links. The system of this embodiment is, in general, similar to the one described with reference to FIGS. 2 through 8. Therefore parts and units of the system of this invention similar to those of the previous embodiment will be designated with the same reference numerals with an addition of 100. However, the embodiment of FIG. 9 differs from the embodiment of FIGS. 2 through 8 in that a gate arm 123 is turned between the closed position shown in FIG. 9 by solid lines and the open position shown in FIG. 9 by broken lines 123' from an existing separate motor 150'. In other words, the drive of the gate arm 123 does not have kinematic connection with the drive motor 150 of the cogs. The drive motor 150' of the gate arm 123 is controlled from the conventional railroad traffic controller (not shown) via signal line 124. The drive motor 150' is electrically connected to motor 150 via a limit switch 150*e,* wires 150*a* and 150*b,* a controller 150*c,* and a relay, e.g., a solid-state relay 150*d*. The limit switch is shown in an upside-down position conventionally to illustrate that it engages with the rear end 123*b* of gate arm 123. The source of electric power supply (not shown) is connected with the motor 150 via wires 162*a* and 162*b* and with the motor 150' via wires 163*a* and 163*b*. The rest of the system of the embodiment of FIG. 9, including the construction of the cogs shown in FIG. 4, the electric circuit of the sensors shown in FIG. 7, and the arrangement of the sensor shown in FIG. 6 and operation of these devices and units remain the same as described in connection with the previous embodiment.

When the central traffic controller (not shown) sends a command via the line 124 to motor 150' for closing the gate arm 123 into the position shown by solid lines in FIG. 9, the motor 150' is started and turns the gate arm 123 from the open position 123' to the closed position shown in FIG. 9 by the solid line. When the gate arm 123 reaches the final closed position, its rear end 123*b* engages the limit switch 150*e,* whereby the circuit (163*a,* 163*b*) that supplied the electric motor 150 is closed via the controller 150*c* and relay 150*d*. The rest of the operation remains the same, i.e., the motor 150 rotates the shaft 130 so that the cogs 142*a,* 142*b,* . . . 142*n* are turned into the same position which is shown for cog 42*a* by solid lines in FIG. 4. The heel of the cog activates the limit switch, and so on.

Thus it has been shown that the present invention provides a system for preventing accidents caused by collision of railroad trains with vehicles on highway-railroad crossings. The system of the invention is simple in construction and maintenance, inexpensive to manufacture, reliable in operation, and prevents motorists from going around railroad gates in their working or road-closing positions. The invention provides a vehicle barrier, which is retractable from the ground when the highway gate is closed, and which is interlocked with a warning signal activated when a vehicle is stuck on the railroad tracks with the barrier in an upright position.

Although the invention was shown and described with reference to specific embodiments having specific materials and shapes of the parts and units of the apparatus, it is understood that these embodiments were given only as examples and that any modifications and changes are possible, provided they do not depart from the scope of the patent claims attached below. For example, the drive motor 50 can be connected to the gate arms via transmission mechanisms different from a gear and rope system, e.g., through a wireless remote control system or the like. The vehicle-stopping retractable barrier can be made in the form different from tire-piercing cogs, e.g., in the form of high, strong and reinforced physical barriers impenetrable by vehicles or having inflatable shock-absorbing surfaces to prevent the vehicle from damage. On the contrary, when the vehicle barrier is intended for protection of military bases or other important objects from the terrorist's attacks, the barriers may be of a more severe nature. The cogs can be driven via kinematic links from the motor of the gate arm, rather than from the motor of the cogs via kinematic links to the gate arm.

What is claimed is:

1. A railroad accident prevention system in combination with a railroad crossing having railroad tracks passing through said railroad crossing and with at least one gate arm which is lowered from an upright gate open position to a horizontal gate closed position under control of a remote controller activated when a train approaches along said railroad tracks to said railroad crossing, comprising:

at least one ground-retractable vehicle barrier means for preventing penetration of a vehicle to said railroad tracks when said gate arm is in a closed position; and drive means for switching said gate arm between said upright gate open position and said horizontal gate closed position, said drive means being activated by a signal from said remote controller;

a first sensor means capable of sensing the presence of an obstacle on the path of said train through said railroad crossing when said at least one gate arm is turned into said closed position;

an alarm means capable of generating a signal selected from an audible signal and a visible signal;

first interlock means connected to said drive means and interlocking said at least one sensor means with said alarm means for activating said alarm means when said sensor senses said obstacle with said at least one gate arm in said closed position; and a second sensor means located at a point ahead of said railroad crossing on the way of said train, said second sensor means being responsive to the presence of said train; and second interlock means between said second sensor means and said alarm means for deactivation of said alarm means in response to the train when no obstacle is sensed by said first sensor means on the railroad crossing;

wherein said first interlock means and said second interlock means are switching means selected from electromechanical relays and a solid state relays, said first interlock means and said second interlock means being connected to said alarm means through a respective controller and said relays, said first and second sensor means comprising a resonance-type oscillating circuit consisting of an oscillating voltage generator, a capacitance, and a sensitive element capable of violating resonance conditions of said oscillating circuit in response to a mass of an object stuck on said railroad crossing.

2. The system of claim 1, wherein said sensitive element is selected from a group consisting of a weight-responsive second capacitance and inductance-sensitive element sensitive to the presence of ferromagnetic objects.

3. The system of claim 2, wherein said second capacitance comprises a dilatometer consisting of a pair of metal plates and a resilient nonconductive material between said plates so that a distance between said plates varies under the effect of the mass of an object located above said second capacitance, thus violating said resonance conditions.

4. A railroad accident prevention system in combination with a railroad crossing having railroad tracks passing through said railroad crossing and with at least one gate arm which is lowered from an upright gate open position to a horizontal gate closed position under control of a remote controller activated when a train approaches the railroad crossing, comprising:

at least one ground-retractable vehicle barrier means for preventing penetration of a vehicle to the railroad tracks when said gate arm is in a closed position; and drive means for switching said gate arm between said upright gate open position and said horizontal gate closed position, said drive means being activated by a signal from said remote controller;

said drive means being an electric motor having a drive shaft, said at least one ground-retractable vehicle barrier means comprising a plurality of cogs rigidly attached to said drive shaft, each said cog being made in the form of a double-arm lever with the pivot point on said drive shaft, said double arm lever having a first arm capable of projecting above the ground and functioning as an obstacle for a vehicle, and a second arm functioning as a stopper against a stationary object that prevents further rotation of said cog;

at least one recess below the ground level on said railroad crossing, said drive motor, said drive shaft and said plurality of cogs on said drive shaft being located in said recess, said drive shaft being substantially parallel to railroad tracks passing through said railroad crossing, said first arm being formed as a sharp tooth, in said projecting position said sharp tooth being inclined under an acute angle toward oncoming vehicles;

said drive motor being kinematically connected to said at least one gate arm through a transmission mechanism;

said transmission mechanism comprising a gear reducer for transmitting rotation in mutually perpendicular directions and flexible elements connected to said reducer for lowering said gate arm when said drive motor rotates in one direction and for raising said gate arm when said drive motor rotates in a direction opposite to said one direction;

a first sensor means capable of sensing the presence of an obstacle on the path of said train through said highway-railroad crossing when said at least one gate arm is turned into said closed position;

an alarm means capable of generating a signal selected from an audible signal and a visible signal;

first interlock means connected to said drive means and interlocking said at least one sensor means with said alarm means for activating said alarm means when said sensor senses said obstacle with said at least one gate arm in said closed position; and a second sensor means located at a point ahead of said railroad crossing on the way of said train, said second sensor means being responsive to the presence of said train; and second interlock means between said second sensor means and said alarm means for preventing activation of said alarm means in response to the train when no obstacle is sensed by said first sensor means on the railroad crossing;

said first interlock means and said second interlock being a pair of switching means selected from electromechanical relays and solid-state relays, said first interlock means and said second interlock means being connected to said alarm means through a respective controller and said relays;

said first and second sensor means comprising a resonance-type oscillating circuit consisting of an oscillating voltage generator, a capacitance, and a sensitive element capable of violating resonance conditions of said oscillating circuit in response to a mass of an object having ferromagnetic parts.

5. The system of claim 4, wherein said sensitive element is selected from a group consisting of a weight-responsive second capacitance and inductance-sensitive element sensitive to the presence of ferromagnetic objects.

6. The system of claim 5, wherein said second capacitance comprises a dilatometer consisting of a pair of metal plates and a resilient nonconductive material between said plates so that a distance between said plates varies under the effect of the mass of an object located above said capacitance, thus violating said resonance conditions.

7. The system of claim 4 comprising a pair of said first sensor means for sensing vehicles passing through said railroad crossing in opposite directions, said first sensor means comprising an oscillating voltage generator, a capacitance, and a plurality of sensitive elements connected in parallel, located at least between said railroad tracks of said railroad crossing, and being capable of violating resonance conditions of said oscillating circuit in response to a mass of an object that may present an obstacle for said train.

8. A railroad accident prevention system in combination with a railroad crossing having railroad tracks passing through said railroad crossing and with at least one gate arm which is lowered from an upright gate open position to a horizontal gate closed position under control of a remote controller activated when a train approaches along said railroad tracks to said railroad crossing, comprising:

at least one ground-retractable vehicle barrier means for preventing penetration of a vehicle to said railroad tracks when said gate arm is in a closed position; and drive means for switching said gate arm between said upright gate open position and said horizontal gate closed position, said drive means being activated by a signal from said remote controller, said drive means comprising a first drive motor for driving said gate arm and a second drive motor for driving said at least one barrier means, said first drive motor and said second drive motor being interlocked with each other via a limit switch, controller, and a relay means, said limit switch being engageable with said gate arm when said gate arm comes to a closed position, so that activation of said first drive motor activates said second drive motor.

9. The system of claim 8, where said second drive motor has a drive shaft, said at least one ground-retractable vehicle barrier means comprising a plurality of cogs rigidly attached to said drive shaft, each said cog being made in the form of a double-arm lever with the pivot point on said drive shaft, said double arm lever having a first arm capable of projecting above the ground and functioning as an obstacle for said vehicle, and a second arm functioning as a stopper against a stationary object that prevents further rotation of said cog.

10. The system of claim 9, further comprising at least one recess below the ground level on said railroad crossing, said second drive motor, said drive shaft and said plurality of cogs on said drive shaft being located in said recess, said drive shaft being substantially parallel to railroad tracks passing through said railroad crossing, said first arm being formed as a sharp tooth, in said projecting position said sharp tooth being inclined under an acute angle toward oncoming vehicles.

11. The system of claim 8, further comprising:

a first sensor means capable of sensing the presence of an obstacle on the path of said train through said highway-railroad crossing when said at least one gate arm is turned into said closed position;

an alarm means capable of generating a signal selected from an audible signal and a visible signal;

first interlock means connected to said second drive means and interlocking said at least one sensor means with said alarm means for activating said alarm means when said sensor senses said obstacle with said at least one gate arm in said closed position; and a second sensor means located at a point ahead of said railroad crossing on the way of said train, said second sensor means being responsive to the presence of said train; and second interlock means between said second sensor means and said alarm means for deactivation of said alarm means in response to the train when no obstacle is sensed by said first sensor means on the railroad crossing.

12. The system of claim 11, wherein said first interlock means and said second interlock means comprise switching means selected from electromechanical relays and a solid state relays, said first interlock means and said second interlock means being connected to said alarm means through a respective controller and said relays.

13. The system of claim 12, wherein said first and second sensor means comprise a resonance-type oscillating circuit consisting of an oscillating voltage generator, a capacitance, and a sensitive element capable of violating resonance conditions of said oscillating circuit in response to a mass of an object stuck on said railroad crossing.

14. The system of claim 13, wherein said sensitive element is selected from a group consisting of a weight-responsive second capacitance and inductance-sensitive element sensitive to the presence of ferromagnetic objects.

15. The system of claim 14, wherein said second capacitance comprises a dilatometer consisting of a pair of metal plates and a resilient nonconductive material between said plates so that a distance between said plates varies under the effect of the mass of an object located above said second capacitance, thus violating said resonance conditions.

16. The system of claim 8, wherein said ground-retractable vehicle barrier means have light-reflective elements.

* * * * *